United States Patent [19]

Ibrahim

[11] Patent Number: 4,478,047

[45] **Date of Patent: * Oct. 23, 1984**

[54] ENERGY EFFICIENT GLASS DOOR MERCHANDISER

[75] Inventor: Fayez F. Ibrahim, Niles, Mich.

[73] Assignee: Tyler Refrigeration Corporation, Niles, Mich.

[ * ] Notice: The portion of the term of this patent subsequent to Apr. 20, 1999 has been disclaimed.

[21] Appl. No.: 349,323

[22] Filed: Feb. 16, 1982

Related U.S. Application Data

[63] Continuation of Ser. No. 145,712, May 1, 1980, Pat. No. 4,325,227, which is a continuation-in-part of Ser. No. 25,473, Mar. 30, 1979, Pat. No. 4,245,482, which is a continuation-in-part of Ser. No. 58,916, Jul. 19, 1979, Pat. No. 4,242,882, which is a continuation-in-part of Ser. No. 101,069, Dec. 7, 1979, Pat. No. 4,265,090, and Ser. No. 124,544, Feb. 25, 1980, Pat. No. 4,389,852.

[51] Int. Cl.[3] ..... F25D 21/12

[52] U.S. Cl. ..... 62/82; 62/248; 62/256

[58] Field of Search ..... 62/255, 256, 820, 402, 62/246, 248, 252, 253

[56] References Cited

U.S. PATENT DOCUMENTS

| | | | |
|---|---|---|---|
| 1,629,408 | 5/1927 | Peacock | 62/248 |
| 3,025,681 | 3/1962 | Booth | 62/248 |
| 3,496,732 | 2/1970 | Vogel et al. | 62/256 X |
| 4,145,893 | 3/1979 | Vogel | 62/255 |
| 4,161,868 | 7/1979 | Kennedy et al. | 62/256 |

*Primary Examiner*—Lloyd L. King

*Attorney, Agent, or Firm*—LeBlanc, Nolan, Shur & Nies

[57] ABSTRACT

A refrigerated display case having a display section within a cabinet and a movable door covering a front access opening to such display section. The door includes a frame member in which two glass members are mounted with an air space between the glass members. A refrigeration air conduit extends along the top, bottom and rear walls of the cabinet. The air conduit has an outlet opening and an inlet opening at opposing ends thereof with the openings being in alignment so that air leaving the outlet opening will be directed towards and received by the inlet opening thereby forming an air curtain across the front opening of the cabinet along the path inside the door. During a refrigeration cycle of operation of the display case, refrigerated air is circulated through the air conduit and a refrigeration mechanism arranged within the conduit so as to establish a refrigerated air band and a refrigerated air curtain across the front opening in the cabinet. In order to minimize any accumulation of condensation between the glass members in the door, an ambient air flow between the glass members is established when the door is in a closed position. During a defrost cycle of operation, the refrigeration mechanism is turned off and the door covering the front access opening is slightly opened. Ambient air is then drawn into the refrigeration air conduit and circulated through the conduit. Such ambient air serves to defrost the refrigeration mechanism and the interior of the refrigeration air conduit.

41 Claims, 8 Drawing Figures

ENERGY EFFICIENT GLASS DOOR MERCHANDISER

RELATED APPLICATIONS

This is a continuation of application Ser. No. 145,712, filed May 1, 1980, which is also a continuation-in-part of patent applications: Ser. No. 25,473 filed Mar. 30, 1979 and entitled Glass Door Merchandiser, now U.S. Pat. No. 4,245,482; Ser. No. 58,916 filed July 19, 1979 and entitled Glass Door Merchandiser, now U.S. Pat. No. 4,242,882; Ser; No. 101,069 filed Dec. 7, 1979 and entitled Glass Door Merchandiser with Ambient Air Defrost, now U.S. Pat. No. 4,265,090; and Ser. No. 124,544 filed Feb. 25, 1980 and entitled One and a Half Band Refrigerated Display Case, now U.S. Pat. No. 4,389,852. All of these applications are hereby incorporated by reference.

BACKGROUND OF THE INVENTION

The present invention primarily relates to a glass door merchandiser type of refrigerated display case. While reference is made herein to the use of glass doors since these are the types of doors most frequently utilized, other types of doors can be used within the scope of the present invention. In addition, the term refrigerated, in accordance with the present invention, is intended to incorporate both those cases maintained at a temperature either at or in excess of 32° F., such as display cases utilized for displaying milk and fresh foods, and those cases maintained below 32° F., such as frozen food cases.

During the operation of glass door refrigerated merchandiser display cases, there is a tendency for condensation to accumulate between the two glass members mounted in the door frame. In order to minimize such condensation, electric resistance heaters are mounted outside the door. The electrical heaters apply sufficient heat to the glass members and to minimize the condensation occurring on the glass. The use of such electrical resistance heaters give rise to several disadvantages. First, the heaters utilize a substantial amount of electricity thereby increasing the cost of operation. In addition, the application of heat to the glass door also will cause heat to be conveyed into the display case by conduction thereby increasing the refrigeration load and effectively decreasing the efficiency of the case.

Present glass door merchandisers use only one air conduit, this being the refrigeration air conduit in which the evaporator coil is located. For low temperature applications, the air curtain across the access opening of the merchandiser can run as low as −20° F. With heavy customer usage, which results in frequent openings of the door, the heat and mass transfers that penetrate the air curtain become substantial thereby increasing the refrigeration load.

In order to prevent condensation from forming on the outside of a refrigerator or freezer door, U.S. Pat. No. 4,009,586 discloses passing a stream of warm air. The warm air produced by the compressor of the refrigerator is expelled from a location below the door in an upward direction along the outside of the door.

In the operation of all types of refrigerated display cases, it is desirable to include a system capable of automatically defrosting the display case. The defrost cycle can be actuated either at set periodic times or when the frost buildup within the system has reached a certain predetermined level. Such systems are typically thermostatically controlled so as to switch from a refrigeration cycle to a defrost cycle of operation. In this manner of operation, it is possible to avoid any significant frost buildup within the display case.

Typically, within the prior art, there have been three different approaches employed for defrosting refrigerated display cases. The three approaches include: utilizing electric resistance heater; passing a compressed gaseous refrigerant through the refrigeration coils; and, circulating ambient air through the air conduit. Due to the increasing cost of energy in recent years, efforts have been made to place more emphasis on the utilization of ambient air defrost systems in place of the electrical resistance heaters or compressed gaseous refrigerant defrost systems.

One type of system that employs ambient air during the defrost cycle is exemplified by those embodiments illustrated in U.S. Pat. Nos. 3,403,525, 3,850,003 and 3,937,033, all to Beckwith et al. These systems use fans separate and distinct from the main circulating fans. The additional fans are turned on only during the defrost cycle of operation for pulling ambient air from outside of the display case directly into the air conduits. A second type of system is illustrated in U.S. Pat. No. 3,082,612 to Beckwith, which system draws ambient air into the main circulation path through ports located in the lower front panel of the refrigerated display case. Such ports are normally closed during the refrigeration cycle and are opened during the defrosting cycle. The Beckwith, et al. patent U.S. Pat. No. 3,850,003 indicates that the concepts described in U.S. Pat. Nos. 3,082,612 and 3,403,525 did not prove to be practical and hence were not commercially feasible.

Another type of ambient air defrosting system is shown in U.S. Pat. No. 4,144,720 issued to Subera, et al. which is assigned to the same assignee as the present application. In the foregoing patent application, an open front refrigerated display case having primary and secondary air conduits is disclosed. In this system, the direction of air flow within one of the conduits is reversed, for example, by the use of reversible fans for ambient air defrost. U.S. Pat. No. 4,026,121 to Aokage, which illustrates an open front display case, and U.S. Pat. No. 4,120,174 to Johnston, which illustrates an ooen top display case, also disclose reverse ambient air flows for defrosting.

In those ambient air defrost systems disclosed in the above-noted patents which use a reverse air flow, during the defrost cycle of operation, ambient air can easily be drawn through the access opening into the air conduit through the outlet opening of the air conduit and then expelled from the air conduit after the defrost operation through the inlet opening and out of the cabinet through the access opening. Such an arrangement, however, cannot be readily used in a glass door type merchandiser refrigerated display case, since the front opening in the cabinet is covered by the doors. Thus, in order to employ an ambient air defrost system, a different type of system had to be developed.

In seeking to employ ambient air defrost techniques in a glass door case, systems have been developed for drawing in air over a limited portion of the air conduit by opening flaps to the conduit, which flaps are arranged so as to astraddle the evaporator coils of the refrigeration mechanism; such systems are disclosed in U.S. Pat. Nos. 3,226,945 to Spencer and 4,072,438 to Johnston. The patent to Spencer illustrates a plurality of different embodiments of open top refrigerated display cases, both of a single shelf and multishelf type, in which a glass cover is arranged over the opening in the display case. During the refrigeration cycle of operation, air is drawn through the evaporator coils by a positive pressure created upstream of the coils; such air after being refrigerated is circulated through the air conduit and into the display section of the case. The patent to Johnston discloses a glass door type merchandiser display case in which air is circulated through the air conduit and through the evaporator coils arranged within the air conduit in such a direction that cold air enters from the bottom of the opening in the cabinet and after passing across such opening is then drawn back into the air conduit by an air inlet located at the top of the opening in the cabinet. Such systems are relatively complex and can involve certain operational problems.

SUMMARY OF THE INVENTION

An object of the present invention is to provide an improved glass door refrigerated display case.

Another object of the present invention is to provide a glass door refrigerated display case in which accumulation of condensation on the glass members is substantially prevented without requiring the use of electrical resistance heaters.

A further object is to provide an improved efficiency glass door refrigerated display case.

A still further object of the present invention is to provide a glass door refrigerated display case that creates a protective air curtain between the glass door and the refrigerated air curtain so as to improve the efficiency of operation of the display case.

Still another object of the present invention is to provide an improved ambient air defrosting open front refrigerated display case that has a movable door covering the access opening into the display section of the display case and avoids the problems involved in the operation of the ambient air defrost cycle.

Another object of the present invention is to provide an improved refrigerated display case having a movable door covering the front access opening with an improved ambient air defrost system.

A further object of the present invention is to provide an improved refrigerated display case having a movable door covering its front access opening that provides for a more efficient ambient air defrost operation than previously known display cases of this type.

Still another object of the present invention is to provide an improved glass door merchandiser refrigerated display case utilizing an improved ambient air defrost system.

A still further object of the present invention is to provide an improved glass door merchandiser refrigerated display case utilizing an improved ambient air defrost system where during the defrost operation ambient air is circulated through at least a substantial portion of the air conduit and such ambient air is expelled through the front access opening after passing through the air conduit.

These objectives are achieved by the provision of a glass door type refrigerated display case in accordance with the present invention and the operation of such a case in accordance with the present invention. The refrigerated display case of the present invention has a cabinet with top, bottom, rear and side walls with an opening in its front and a display section within the cabinet. At least one door, which is generally a glass door, covers the front opening. The door is movable so as to enable access through the front opening to products within the display section of the display case. An air conduit extends along the top, bottom and rear walls of the cabinet and has an outlet opening and an inlet opening at opposing ends thereof. The outlet opening and the inlet opening are arranged in alignment so that air leaving the outlet opening will be directed towards and received by the inlet opening so as to form an air curtain across the front opening of the cabinet along a path inside of the door. In the air conduit, there are a refrigeration mechanism, which is typically either a single or plurality of evaporator coils, and at least one fan for circulating air through the conduit. The evaporator coils are located upstream of the fan so that air is circulated through the coils by a positive pressure air flow. During the refrigeration cycle of operation, ambient air is circulated through the glass door in order to minimize any accumulation of condensation within the door. Between the refrigerated air curtain and the glass door, a secondary air curtain is formed for protecting the refrigerated air curtain and thereby improving the efficiency of operation of the display case.

This display case is capable of being defrosted using ambient air. When a defrost cycle is to occur, a control mechanism switches the display case into a defrost mode. During the defrost mode of operation the evaporator coils are turned off and ambient air is drawn into the air conduit and circulated through at least a substantial portion of the conduit, including that portion along the rear wall of the cabinet and that portion containing the evaporator coils, thereby defrosting the evaporator coils in the interior of the air conduit. After the ambient air has passed through the air conduit, it is expelled from the cabinet through the front access opening. In order to allow the ambient air to be so expelled, during the defrost cycle of operation, the door covering the access opening is opened slightly, preferably sufficiently to provide approximately a one inch gap between the frame and the door. The ambient air then can be directed so as to be expelled from the conduit in a direction out through the opening formed by the open door and in a path away from the display case.

The air outlet and inlet openings of the air conduit are aligned along a substantially vertical path across the front opening of the cabinet with the air outlet opening being near the top wall of the cabinet. Thus, during a refrigeration cycle of operation, a curtain of refrigerated air extends in a substantially vertical direction flowing from top to bottom across the front opening of the cabinet. During the defrost cycle of operation, the direction of air flow through the conduit is reversed as compared to the direction of air flow during a refrigeration cycle of operation.

An ambient air conduit can be arranged above the display case in such a location that it can create an ambient air flow across the front of the case. The ambient air conduit is provided with an outlet opening with two portions. The first outlet opening portion is positioned so that is creates a flow of ambient air through the glass door when it is in its closed position. For this purpose both the top and bottom frame portions of the door have a plurality of perforations thereby allowing the air to enter the space between the two glass members of the door, flow through the door and then be expelled from the door. The second outlet opening portion of the ambient air conduit is positioned so that it creates a flow of ambient air across the front of the case along a path lying outside of the glass door.

In order to improve the efficiency of operation of the glass door refrigerated display case by reducing the effects of frequent use of the case on the refrigeration load, a protective secondary air band is established. This secondary air band creates a secondary air curtain across the front access opening of the display case in a position between the refrigerated air curtain and the glass door. The secondary air curtain can be established using either a partial secondary air conduit, which receives air flowing along the refrigeration air conduit, or a full secondary air conduit which extends entirely around the refrigeration air conduit and has a separate set of fans for circulating air through such conduits. In both embodiments, the air flowing through the secondary air conduit while unrefrigerated is substantially cooler than the ambient air outside of the display case.

While reference is made herein to the utilization of a fan for circulating air through the air conduit, it is noted that more than one fan may be utilized within the display case. The number of fans employed depends on the length of the display case. Typically, an eight foot long display case utilizes two air circulating fans and a twelve foot case would use three air circulating fans. The number of fans, however, can be varied depending on the length of the case and the sizes of the fans. Likewise, the number of doors covering the front opening of the cabinet would vary depending on the length of the display case, with more doors being utilized for longer display cases. The doors are attached to the case by hinges spring biased for closing the doors.

The ambient air for defrosting the display case can be drawn into the air conduit either through an aperture in the top of the cabinet or through an opening formed by opening the door of the case. In the later embodiment, the door covering the access opening is opened and the ambient air is drawn from outside of the cabinet through the open door and then in through the air outlet opening into the air conduit. In the prior of the two embodiments, the ambient air is drawn directly into the air conduit through an aperture in the top of the cabinet that is opened during the defrost cycle of operation.

With respect to the embodiment with an aperture in the top of the cabinet, in order to prevent the flow of ambient air into the display section of the display case, a blocking mechanism can be provided for controlling the air flow. The blocking mechanism is provided in conjunction with the aperture within the case that is in communication with the air conduit. When the display case is switched into a defrost cycle of operation, the aperture is opened and simultaneously a blocking member is extended into the air conduit for preventing the flow of air past the location of such blocking member. The direction of air flow through the air conduit is then reversed so that ambient air is drawn into the air conduit through the aperture in the top portion of the display case. The ambient air then passes through the air conduit for defrosting the evaporator coils and such air is expelled through the front access opening since the door has been opened. Thus, the ambient air is drawn in a reversed direction by a negative pressure through the evaporator coils. This type of embodiment is disclosed in detail in the parent applications listed above.

During the defrost cycle of operation care must be taken to ensure that the reverse air flow is not so great that the air expelled from the inlet opening travels across the access opening and is drawn back into the air conduit through the outlet opening. In order to prevent such an occurrence, it is preferable for the air flow during the defrost cycle of operation to be less than the flow during the refrigeration cycle of operation. Such a defrost air flow would be sufficiently low so as to avoid the above-mentioned problem.

In supplying ambient air for the defrost operation, an ambient conduit and fan can be used. This ambient air conduit also can supply the air to pass through the glass door. The arrangement is mounted on the top of the display case. The fan draws air into the ambient air conduit from above the display case which is normally warmer than the air in front of the case and hence will decrease the necessary defrost time.

In the operation of both embodiments, during the defrost cycle the door covering the front access opening in the cabinet is opened slightly to provide an open gap of between one and four inches preferably about one inch for drawing in ambient air. To accomplish this, a motor is connected to a drive linkage with a separate push rod associated with each door and arranged for pushing each door open during the defrost cycle. While normally a single motor can be used for controlling all of the doors of the display case, it is possible to use a separate motor for controlling each door. The motors typically would be mounted on the top of the cabinet and each motor has a pivotable lever that is arranged in contact with a pin member extending upwardly above the top of the door.

In the second embodiment, the open door also provides a path for drawing ambient air into the air conduit. Ambient air can be drawn into the air conduit from outside of the display case through the open door and then through the air outlet opening of the conduit. In this embodiment, the aperture in the top of the cabinet can be eliminated.

During the refrigeration operation, there is often a buildup of condensation at the location of the air inlet of the air conduit. This buildup of condensation occurs since the air moving across the front opening in the cabinet picks up moisture from the inside display section, which moisture is picked up from the ambient air when the door of the display case is opened. The buildup of condensation can and often does result in accumulation of a frost buildup which blocks at least a portion if not the entire inlet opening, thereby decreasing the efficiency of operation of the display case. In as much as the ambient air during defrost is not being circulated through the inlet opening, the defrosting system will not serve to eliminate any frost buildup at the inlet opening. Consequently, some other mechanism must be provided in order to eliminate this buildup of frost at the inlet opening. For this purpose, a liquid refrigerant line can be arranged in the area of the inlet opening. Such line carries the liquid refrigerant before it is sent to the evaporator. Since such refrigerant is warmer than the refrigerated air, it will serve to maintain the temperature of the air in the area immediately surrounding the inlet opening at a level above the dew point, thereby minimizing the buildup of condensation and frost in this area. The use of such liquid lines systems is generally disclosed in U.S. Pat. No. 3,371,503 to Perez.

In operating the refrigerated display case of the present invention, air is circulated through the air conduit in a direction so that the refrigerated air is propelled through the refrigeration mechanism by a positive pressure air flow and such air is circulated through the conduit so as to flow in a substantially vertical direction across the opening in the cabinet in a direction flowing from the top to the bottom of such opening. Such air flow creates a refrigerated air curtain lying along a substantially vertical path with such curtain being located immediately inside of the movable door of the display case. During a defrost cycle of operation, the direction of air flow through the air conduit is reversed and ambient air is drawn into the air conduit, which ambient air serves to defrost the interior of the conduit and the refrigeration mechanism.

DESCRIPTION OF THE PREFERRED EMBODIMENTS

Figure 1:
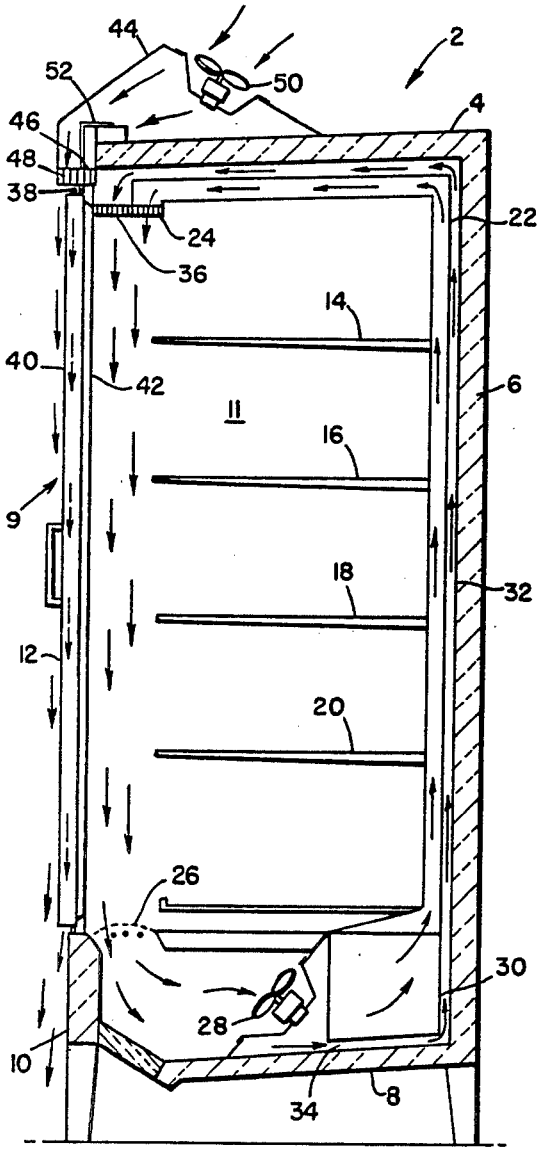
FIG. 1 is a side cross-sectional view of a refrigerated display case in accordance with the present invention when such display case is operating in a refrigeration cycle of operation.

A glass door refrigerated display case 2 has a top wall 4, a rear wall 6, a bottom wall 8 and a front wall 10, as shown in FIG. 1. A glass door 12 covers the access opening 9 to the interior display space 11 of the display case. Within display case 2 are a plurality of shelves, 14, 16, 18 and 20, for the refrigerated products. Encircling interior display space 11 of the glass door merchandiser is a refrigeration air conduit 22. Air conduit 22 has an outlet opening 24 and an inlet opening 26 that are arranged in alignment so that air emitted from outlet opening 24 is directed across access opening 9 inside of interior display space 11 and returns back into the conduit through inlet opening 26.

As the air is circulated through refrigeration air conduit 22, the air is refrigerated by an evaporator coil 30. A set of fans such as represented by fan 28 circulate the air through the refrigeration air conduit in a first direction during the refrigeration cycle of operation such as represented by the arrows in FIG. 1.

A partial secondary air conduit 32 surrounds a portion of refrigeration air conduit 22. Secondary air conduit 32 has an outlet opening 36 that is arranged adjacent to outlet opening 24 and between outlet opening 24 and glass door 12. Secondary air conduit 32 has an inlet opening 34 that receives air that has passed through a portion of refrigeration air conduit 22. Inlet opening 34 can be positioned so as to receive air before it has passed through the evaporator coil at all or after it has passed through a portion of the evaporator coil. Thus, the air circulated through secondary air conduit 32 will be substantially cooler than the ambient air outside of the glass door merchandiser. In the embodiment shown in FIG. 1, the air circulated through secondary air conduit 32 is circulated by fan 28. The air expelled from secondary air conduit 32 through outlet opening 36 forms a secondary air curtain across access opening 9 which lies between the refrigerated air curtain and the glass door. This secondary air curtain serves as a protective barrier between the refrigerated air within the glass door merchandiser and ambient air outside of the merchandiser when glass door 12 is opened for removing products from the case.

Figure 5:
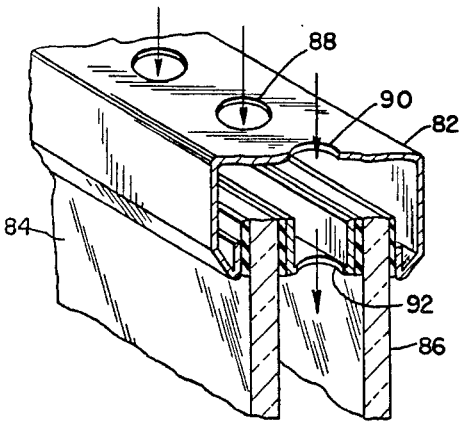
FIG. 5 is a perspective cross-sectional view of a portion of the glass door assembly utilized in accordance with the present invention.

As further described below in connection with FIG. 5, glass door 12 includes a frame 38 in which two glass members 40 and 42 are mounted. An air space exists between glass members 40 and 42 so that ambient air can be circulated between such space. The ambient air flow through glass door 12 is illustrated by the arrows within the door shown in FIG. 1. By circulating ambient air through glass door 12, an accumulation of condensation within the door due to the temperature and moisture differential between the ambient air outside of display case 2 and the refrigerated air inside of display case 2 is substantially if not totally prevented.

The ambient air flow through glass door 12 is created by ambient air conduit 44. Ambient air conduit 44 has an outlet opening with two portions 46 and 48. Portion 46 of the outlet opening of conduit 44 is arranged so as to direct air through glass door 12. As further explained below, for this purpose, the top portion of frame member 38 is provided with a plurality of perforations that allow air to enter the space between glass members 40 and 42. Similarly the bottom of frame 38 is provided with perforations for enabling the air that has passed between the space within the glass door to be emitted from the door. The second portion, 48, of the outlet opening of conduit 44 directs a flow of ambient air along the outside of glass door 12. This flow of ambient air further serves to climinate condensation buildup on the exterior of glass member 40. The air circulated through conduit 44 is drawn into the conduit by a fan 50 from the ambient air above display case 2.

In order to defrost display 2, ambient air is caused to flow through refrigeration air conduit 22 at the same time that evaporator coil 30 is temporarily turned off. In order to enable ambient air to be drawn into the display case, a motorized mechanism 52 causes glass door 12 to open slightly. Glass door 12 opens by a sufficient amount for allowing the requisite ambient air to be drawn into the air conduits, circulated through the conduits and subsequently expelled from the display case through the glass door. This defrost operation is further described below.

Figure 2:
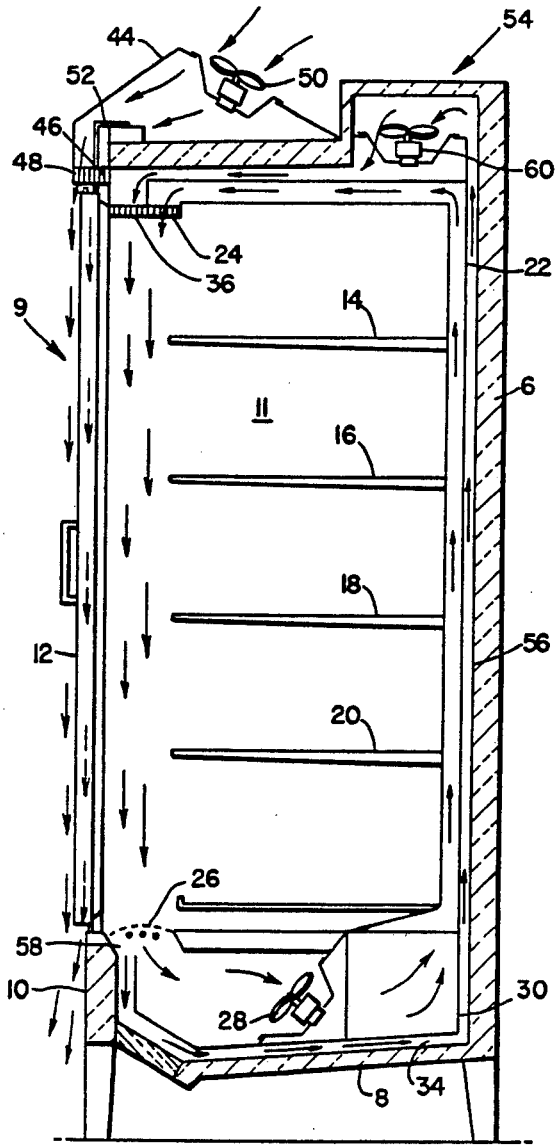
FIG. 2 is a side cross-sectional view of another embodiment of a refrigerated display case in accordance with the present invention when such display case is operating in a refrigeration cycle of operation.

In a modified embodiment of the glass door refrigerated display case, 54, instead of a partial secondary air conduit, a full secondary air conduit 56 can be provided. Air conduit 56 extends entirely around refrigeration air conduit 22 and has a separate set of fans, represented by fan 60, for circulating air through such conduits. Secondary air conduit 56 has the same outlet opening 36 as secondary air conduit 32 but also has an inlet opening 58 which is arranged adjacent to inlet opening 26 of refrigeration air conduit 22. Here again during the refrigeration cycle of operation, a secondary air curtain located between the refrigerated air curtain and glass door 12 is established across access opening 9. The air flow patterns through display case 54 during a refrigeration cycle of operation are shown by the arrows in FIG. 2. Except for the inclusion of the full secondary air conduit with the associated separate set of fans and the related operation, the other elements of the display case and their operation are similar to those of the display case illustrated in FIG. 1. Like elements, therefore, have been identified with the same reference numerals.

In order for the ambient air to pass through the glass door during a refrigeration cycle, when the glass door is in a closed position, a plurality of perforations are provided in the top and bottom portions of the glass door frame. As shown in the top view of the glass door in FIG. 5, top frame member 82 secures two glass members 84 and 86 with a space between them. On its outer side top frame portion 82 has a plurality of perforations, such as 88 and 90, and on its inner side has corresponding perforations such as 92. The air enters the perforations, passes through the frame and then travels through the space between glass members 84 and 86. Similar perforations are provided on the bottom portion of the frame for the glass door which allows the air to be expelled from the glass door. While the top frame portion is arranged so as to be in alignment with the ambient air conduit, the bottom portion of the frame is arranged so that the air passing through the door is expelled onto the floor outside of the display case.

Figure 3:
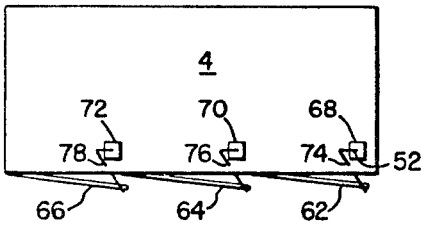
FIG. 3 is a top plan view of a portion of one of the embodiments of the refrigerated display case in accordance with the present invention with the ambient air conduit and fans being removed.
Figure 4:
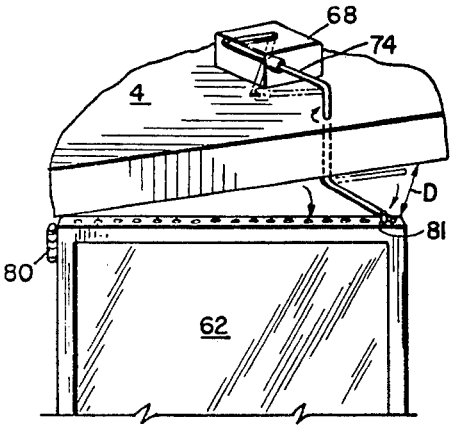
FIG. 4 is a perspective view of a portion of the display case shown in FIG. 3, with the linkage from the rotor for opening the glass door during defrost being shown in both of its positions during the defrost and refrigeration cycles of operation.

During a defrost cycle of operation of the glass door refrigerated display cases of the present invention, the glass doors are slightly opened in order to allow ambient air from outside of the display case to be drawn into the air conduits, passed through the conduits and subsequently expelled from the conduits and the display case back to the ambient atmosphere. The mechanism for opening the glass doors is illustrated in FIGS. 3 and 4. In FIG. 3, a view of top wall 4 of the display case with the ambient air conduit being removed is shown. A separate mechanism 52 for opening each of the glass doors is provided on top wall 4. For a typical display case having three glass doors 62, 64 and 66, motor driven mechanisms 68, 70 and 72, respectively drive linkage members 74, 76 and 78, respectively, for opening the associated doors. When glass door 62, for example, is in its closed position, linkage member 74 is pivoted so that its lower portion extends parallel to the glass door. When the glass door is opened, however, then motor mechanism 68 retracts the connecting arm and is connected to linkage member 74 thereby pivoting linkage member 74 for turning its lower portion in an outward direction where it contacts pin 81 attached to glass door 62 and pivots the door about hinge 80 for slightly opening the door by a distance D. Ideally, the distance D, i.e. the open gap, between the front wall of the display case and the rear of the glass door should be between one and four inches which allows for sufficient air from the ambient atmosphere to be drawn into the air conduits and after passing through the conduits to be expelled from the display case.

Figure 6:
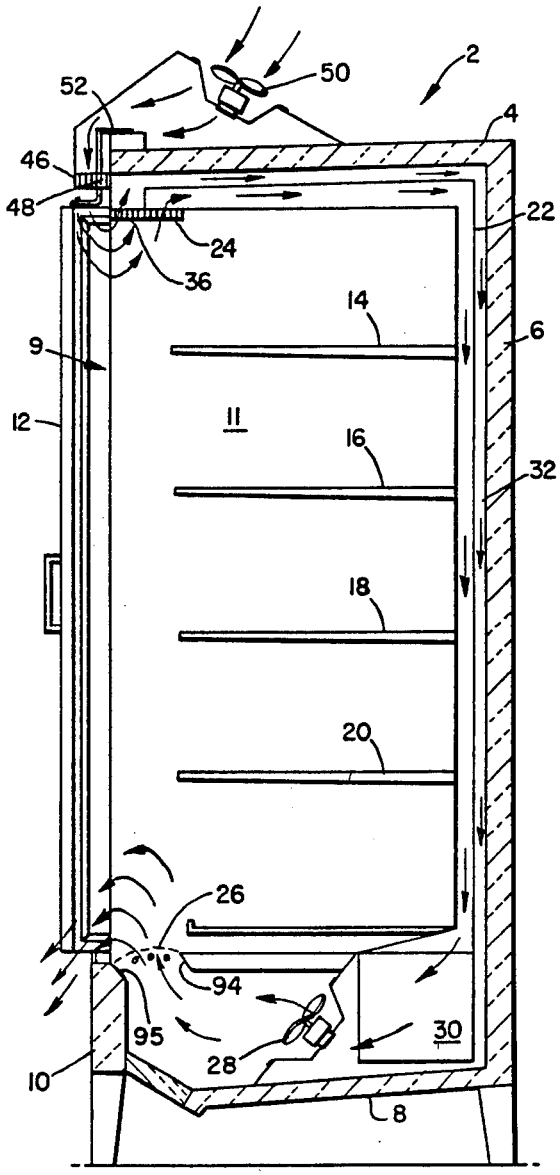
FIG. 6 is a view of the refrigerated display case shown in FIG. 1 when such display case is operating in a defrost cycle of operation.
Figure 7:
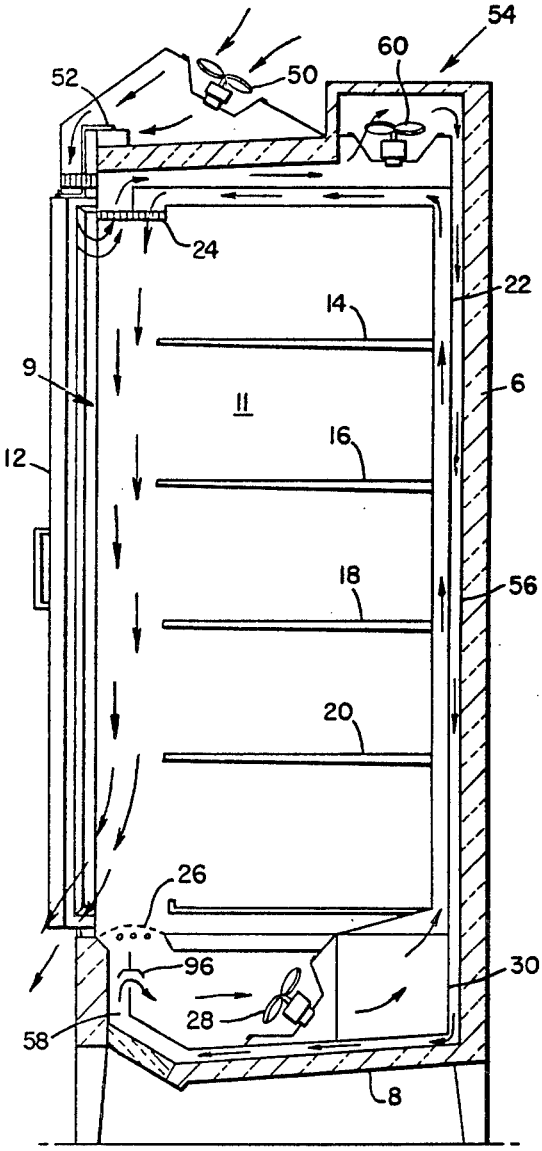
FIG. 7 is a view of the refrigerated display case similar to that shown in FIG. 2 when such display case is operated in a defrost cycle of operation.

During the defrost cycle of operation, the gap formed by the opening of glass door 12 allows ambient air to be drawn into the air conduits 22 and 32, such as shown in FIG. 6. For this purpose the operation of the fans is reversed so as to reverse the air flow through the air conduits. By simultaneously continuing the operation of fan 50 during the defrost cycle of operation, a stream of ambient air emitted through outlet openings 46 and 48 can be drawn into outlet openings 24 and 36 of air conduits 22 and 32, respectively. The air is drawn into the outlet opening since during the defrost cycle of operation the direction of air flow has been reversed. Simultaneously, evaporator coil 30 is temporarily deactivated. Thus, ambient air flows through the air conduits in a direction opposite to the air flow during a refrigeration cycle and is expelled from conduit 22 through inlet opening 26. By sloping the walls 94 and 95 of the conduit in the area of inlet opening 26 the ambient air is directed towards glass door 12 which assists in having the air expelled from the display case such as shown by the arrows in FIG. 6.

In the operation of display case 54, during the defrost cycle, it is possible to only reverse the secondary air flow and maintain the direction of air flow through the refrigeration air conduit. Thus, ambient air from outside of the display case is drawn into air conduit 56 by reversing the direction of operation of fan 60. This ambient air is circulated through air conduit 56 and then diverted into the refrigeration air conduit by an air scoop 96. Alternatively, a plurality of perforations with guide members can be provided for diverting air from the secondary air conduit into the refrigeration air conduit. The ambient air diverted into the refrigeration air conduit is then circulated through such conduit by fan 28 and serves to defrost any frost buildup on evaporator coil 30, which is temporarily deactivated during the defrost cycle of operation. This air circulating through refrigeration air conduit 22 is expelled from outlet opening 24, passes along access opening 9 and then leaves the display case through the opening at the bottom of glass door 12 which has been slightly opened, in the manner explained above.

Figure 8:
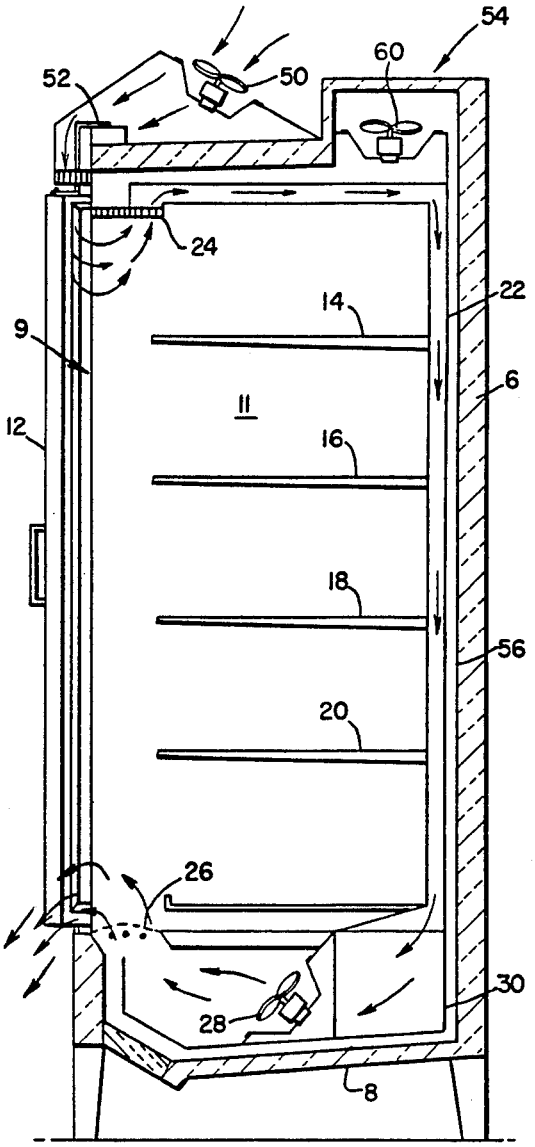
FIG. 8 is another view of the refrigerated display case similar to that shown in FIG. 2 when operated in an alternative operation of the defrost cycle of operation.

Alternatively, in the glass door merchandiser having multiple air conduits, as shown in FIG. 8, the secondary air flow can be turned off while the flow through the refrigeration air conduit is reversed so as to draw in ambient air from outside of the display case. As shown by the arrows in FIG. 8, ambient air is drawn into air conduit 22 by fan 28 through outlet opening 24. This air is then circulated through air conduit 22 and expelled from the conduit through inlet opening 26. As the air passes through air conduit 22 it defrosts the frost buildup on evaporator coil 30, which is temporarily deactivated during the defrost cycle of operation. The air expelled from inlet opening 26 is then directed out of the display case through the opening provided by opening glass door 12.

In an alternative embodiment of the present invention, where a full secondary air conduit extends around the cabinet with inlet and outlet openings at opposing ends of the access opening, the secondary air fans can be operated so that they are only actuated when any of the doors to the display case is opened. When the doors to the display case are closed, the doors act as the protection barrier for the refrigeration air band to insulate the refrigerated air from the warmer air outside the display case. Typically, the ambient air outside of the display case is between 70° and 75° F. while the air inside of the display case can be on the order of −15° F. When any of the doors to the case is opened, a heavy load is placed on the refrigeration system when the warm ambient air comes into contact with the refrigerated air. The use of the secondary air band, as previously discussed, helps to protect the refrigerated air from the ambient air. In a display case that receives heavy usage, the door to the display case is frequently opened and closed and hence the secondary air band can be established on a continuous basis. Where the display case receives less usage, however, it may be unnecessary to run the secondary air band on a continuous basis and due to the energy consumption it may be inefficient. In such situations, the control mechanism for operating the secondary air fans can be operated so as to only actuate the fans when one of the doors to the display case is opened. Thus when the door is opened the protective secondary air curtain is established across the access opening for helping to protect the refrigerated air inside of the case from the ambient air outside of the case.

The present invention may be embodied in other specific forms without departing from the spirit or essential characteristics thereof. The present embodiments are presented as merely illustrative and not restrictive, with the scope of the invention being indicated by the attached claims rather than the foregoing description. All changes which come within the meaning and range of equivalency of the claims, therefore, are intended to be embraced therein.

What is claimed is:

1. A glass door refrigerated display case comprising:

a cabinet having top, bottom, rear and front walls and an interior display space, with an access opening in said front wall for enabling access into said interior display space;

at least one glass door covering said access opening in said front wall, said door being movable into an open position for enabling access to products in said interior display space;

a refrigeration air conduit extending along said top, bottom and rear walls and having an outlet opening and an inlet opening at opposing ends thereof, said outlet opening and said inlet opening being arranged so that air leaving said outlet opening will be directed toward and received by said inlet opening so as to form a refrigerated air curtain across said front opening along a path inside of said door;

refrigeration means including an evaporator coil arranged within said refrigeration air conduit for refrigerating air circulated through said refrigeration air conduit during a refrigeration cycle of operation;

first air circulating means for circulating air through said refrigeration air conduit; and, a secondary air conduit extending at least partially around said refrigeration air conduit and having an outlet opening adjacent to said outlet opening of said refrigeration air conduit for directing air across said access opening along a path inside of said glass door so as to form a secondary air curtain.

2. A glass door refrigerated display case according to claim 1, further comprising means for circulating ambient air through said glass door.

3. A glass door refrigerated display case according to claim 2, wherein said means for circulating ambient air through said door further includes means for establishing an ambient air flow along the outside of said glass door when said glass door is in its closed position.

4. A glass door refrigerated display case according to claim 1 or 3, wherein said secondary air conduit has an inlet opening arranged within said refrigeration air conduit for receiving air passing through said refrigeration air conduit.

5. A glass door refrigerated display case according to claim 4, wherein said inlet opening of said secondary air conduit is arranged so that it receives some air that has passed partially through said evaporator coil of said refrigeration means so as to establish a temperature gradient in the air flowing through said secondary air conduit.

6. A glass door refrigerated display case according to claim 5, wherein there is approximately a 10° F. gradient in the air flowing through said secondary air conduit.

7. A glass door refrigerated display case according to claim 1 or 3 wherein said secondary air conduit extends entirely around said refrigeration air conduit and has an inlet opening arranged adjacent to said inlet opening of said refrigeration air conduit and further comprising secondary air circulating means for circulating air through said secondary air conduit.

8. A glass door refrigerated display case according to claim 1 or 3 further comprising control means for switching said glass door refrigerated display case into a defrost cycle of operation and during such defrost cycle of operation said control means temporarily turns off said refrigeration means and causes ambient air to be circulated through said refrigeration air conduit.

9. A glass door refrigerated display case according to claim 8, wherein said control means causes said first air circulating means to circulate ambient air through said refrigeration air conduit in a direction opposite to the direction of flow of air during a refrigeration cycle of operation.

10. A glass door refrigerated display case according to claim 6 further comprising control means for switching said glass door refrigerated display case into a defrost cycle of operation and during such defrost cycle said control means temporarily turns off said refrigeration means and causes ambient air to be circulated through said refrigeration air conduit.

11. A glass door refrigerated display case according to claim 10, wherein said control means causes said first air circulating means to circulate ambient air through said refrigeration air conduit in a direction opposite to the direction of flow during a refrigeration cycle of operation.

12. A glass door refrigerated display case according to claim 11, wherein said first air circulating means also causes ambient air to flow through said secondary air conduit during a defrost cycle of operation and for such air to flow in a direction opposite the direction of flow during a refrigeration cycle of operation and such ambient air flow through said secondary air conduit being such that it transfers heat by conduction and convection to the air flowing through said refrigeration air conduit during a defrost cycle of operation.

13. A glass door refrigerated display case according to claim 7 further comprising control means for switching said glass door refrigerated display case into a defrost cycle of operation and during such defrost cycle of operation said control means temporarily turns off said refrigeration means and causes ambient air to be circulated through said refrigeration air conduit.

14. A glass door refrigerated display case according to claim 8, wherein during a defrost cycle of operation said control means causes said secondary air circulating means to draw ambient air into said secondary air conduit so as to flow in a direction opposite the direction of air flow during a refrigeration cycle of operation and said first air circulating means maintains a flow of air in the same direction during a defrost cycle of operation as during a refrigeration cycle of operation and further comprising means for diverting ambient air from said secondary air conduit into said refrigeration air conduit during a defrost cycle of operation.

15. A glass door refrigerated display case according to claim 13, wherein said control means causes both said first air circulating means and said second air circulating means to cause ambient air to flow through said refrigeration air conduit and said secondary air conduit, respectively, in a direction during a defrost cycle of operation that is opposite to the direction of air flow during a refrigeration cycle of operation.

16. A glass door refrigerated display case according to claim 14 further comprising means for opening said glass door during a defrost cycle of operation so that said secondary air circulating means can draw in ambient air from outside of said display case during such defrost cycle of operation.

17. A glass door refrigerated display case according to claim 15 further comprising means for opening said glass door during a defrost cycle of operation so that both said first air circulating means and said second air circulating means can draw in ambient air for circulation through said refrigeration air conduit and said secondary air conduit, respectively, during a defrost cycle of operation.

18. A glass door refrigerated display case according to claim 17 further comprising means for opening said glass door during a defrost cycle of operation and said control means reversing the direction of flow through said refrigeration air conduit, causing said first air circulating means to draw ambient air into said refrigeration air conduit and turning off said second air circulating means.

19. A glass door refrigerated display case comprising:

a cabinet having top, bottom, rear and front walls and an interior display space, with an access opening in said front wall for enabling access into said interior display space;

at least one glass door covering said access opening in said front wall, said door being movable into an open position for enabling access to products in said interior display space, said door having two glass members mounted within a frame with a space between said glass members;

a refrigeration air conduit extending along said top, bottom and rear walls and having an outlet opening and an inlet opening at opposing ends thereof, said outlet opening and said inlet opening being arranged so that air leaving said outlet opening will be directed toward and received by said inlet opening so as to form a refrigerated air curtain across said front opening along a path inside of said door;

refrigeration means including an evaporator coil arranged within said refrigeration air conduit for refrigerating air circulated through said refrigeration air conduit during a refrigeration cycle of operation;

first air circulating means for circulating air through said refrigeration air conduit; and means for minimizing condensation outside said glass members without requiring utilization of an electrical heater.

20. A glass door refrigerated display case according to claim 19, wherein said means for minimizing condensation includes means for circulating ambient air through said glass door.

21. A glass door refrigerated display case according to claim 20, wherein said means for circulating ambient air through said door includes an ambient air conduit having an outlet opening arranged in alignment with said glass door for directing air between said glass members when said glass door is in a closed position and ambient air circulating means for drawing ambient air into said ambient air conduit and circulating ambient air through said ambient air conduit.

22. A glass door refrigerated display case according to claim 21, wherein said means for circulating ambient air further includes means for establishing an ambient air flow along the outside of said glass door when said glass door is in its closed position.

23. A glass door refrigerated display case according to claim 19 further comprising: a secondary air conduit extending at least partially around said refrigeration air conduit and having an outlet opening adjacent to said outlet opening of said refrigeration air conduit for directing air across said access opening along a path inside of said glass door so as to form a secondary air curtain.

24. A glass door refrigerated display case according to claim 23, wherein said secondary air conduit has an inlet opening arranged within said refrigeration air conduit for receiving air passing through said refrigeration air conduit.

25. A glass door refrigerated display case according to claim 24, wherein said inlet opening of said secondary air conduit is arranged so that it receives some air that has passed partially through said evaporator coil of said refrigeration means so as to establish a temperature gradient in the air flowing through said secondary air conduit.

26. A glass door refrigerated display case according to claim 25, wherein there is approximately a 10° F. gradient in the air flowing through said secondary air conduit.

27. A glass door refrigerated display case according to claim 23, wherein said secondary air conduit extends entirely around said refrigeration air conduit and has an inlet opening arranged adjacent to said inlet opening of said refrigeration air conduit and further comprising secondary air circulating means for circulating air through said secondary air conduit.

28. A glass door refrigerated display case according to claim 19 or 23 further comprising control means for switching said glass door refrigerated display case into a defrost cycle of operation and during such defrost cycle of operation said control means temporarily turns off said refrigeration means and causes ambient air to be circulated through said refrigeration air conduit.

29. A method of operating a glass door refrigerated display case having a cabinet with an access opening in its front wall for enabling access into an interior display space within the cabinet, at least one glass door covering the access opening, such glass door being movable into an open position for enabling access to products within the interior display space and having two glass members mounted within a frame with a space between such glass members, a refrigeration air conduit extending along the cabinet with an outlet opening and an inlet opening arranged at opposing ends of the access opening, the method comprising the steps of:

circulating air through the refrigeration air conduit with such air being emitted from the outlet opening, directed across the access opening and received back into the inlet opening during a refrigeration cycle of operation;

refrigerating the air circulated through the refrigeration air conduit during a refrigeration cycle of operation; and, circulating ambient air through the glass door outside the glass members so as to minimize any accumulation of condensation within the glass door.

30. A method according to claim 29 further comprising the step of establishing a secondary air curtain across the access opening lying outside of the refrigerated air curtain but inside of the glass door.

31. A method according to claim 29 further comprising the step of establishing an ambient air flow along the outside of the glass door when the glass door is in its closed position.

32. A method according to claim 29, 30 or 31 further comprising the step of switching the display case into a defrost cycle of operation and during such defrost cycle of operation circulating ambient air through the refrigeration air conduit so as to defrost any frost buildup within such conduit.

33. A refrigerated display case comprising:

a cabinet having top, bottom, rear and front walls and an interior display space, with an access opening in said front wall for enabling access into said interior display space;

at least one door covering said access opening in said front wall, said door being movable into an open position for enabling access to products in said interior display space;

a refrigeration air conduit extending along said top, bottom and rear walls and having an outlet opening and an inlet opening at opposing ends thereof, said outlet opening and said inlet opening being arranged so that air leaving said outlet opening will be directed toward and received by said inlet opening so as to form a refrigerated air curtain across said front opening along a path inside of said door;

refrigeration means including an evaporator coil arranged within said refrigeration air conduit for refrigerating air circulated through said refrigeration air conduit during a refrigeration cycle of operation;

first air circulating means for circulating air through said refrigeration air conduit;

a secondary air conduit extending around said refrigeration air conduit and having an outlet opening and an inlet opening respectively adjacent to said outlet opening and said inlet opening of said refrigeration air conduit for directing air across said access opening along a path inside of said glass door so as to form a secondary air curtain;

second air circulating means for circulating air through said secondary air conduit; and, actuating means for selectively actuating said secondary air circulating means for operation only when said door is opened.

34. A refrigerated display case according to claim 33, further comprising means for establishing an ambient air flow along the outside of said door when said door is in its closed position.

35. A refrigerated display case according to claim 33 or 34 further comprising control means for switching said refrigerated display case into a defrost cycle of operation and during such defrost cycle of operation said control means temporarily turns off said refrigeration means and causes ambient air to be circulated through said refrigeration air conduit.

36. A refrigerated display case according to claim 35, wherein said control means causes said first air circulating means to circulate ambient air through said refrigeration air conduit in a direction opposite to the direction of flow of air during a refrigeration cycle of operation.

37. A refrigerated display case according to claim 35, wherein during a defrost cycle of operation said control means causes said secondary air circulating means to draw ambient air into said secondary air conduit so as to flow in a direction opposite the direction of air flow during a refrigeration cycle of operation and said first air circulating means maintains a flow of air in the same direction during a defrost cycle of operation as during a refrigeration cycle of operation and further comprising means for diverting ambient air from said secondary air conduit into said refrigeration air conduit during a defrost cycle of operation.

38. A refrigerated display case according to claim 35. wherein said control means causes both said first air circulating means and said second air circulating means to cause ambient air to flow through said refrigeration air conduit and said secondary air conduit, respectively, in a direction during a defrost cycle of operation that is opposite to the direction of air flow during a refrigeration cycle of operation.

39. A refrigerated display case according to claim 37 further comprising means for opening said door during a defrost cycle of operation so that said secondary air circulating means can draw in ambient air from outside of said display case during such defrost cycle of operation.

40. A refrigerated display case according to claim 38 further comprising means for opening said door during a defrost cycle of operation so that both said first air circulating means and said second air circulating means can draw in ambient air for circulation through said refrigeration air conduit and said secondary air conduit, respectively, during a defrost cycle of operation.

41. A refrigerated display case according to claim 35 further comprising means for opening said door during a defrost cycle of operation and said control means reversing the direction of flow through said refrigeration air conduit, causing said first air circulating means to draw ambient air into said refrigeration air conduit and turning off said second air circulating means.

* * * * *